US005755535A

United States Patent [19]

Fox

[11] Patent Number: 5,755,535

[45] Date of Patent: May 26, 1998

[54] MINE ROOF TRUSS SYSTEM AND RELATED INSTALLATION METHOD

[75] Inventor: William G. Fox, White Plains, Ky.

[73] Assignee: Triad Support Systems, Inc., White Plains, Ky.

[21] Appl. No.: 697,098

[22] Filed: Aug. 19, 1996

[51] Int. Cl.[6] ..... E21D 21/00

[52] U.S. Cl. ..... 405/288; 405/302.2

[58] Field of Search ..... 405/259.1, 259.5, 405/259.6, 288, 302.2, 303

[56] References Cited

U.S. PATENT DOCUMENTS

| | | | |
|---|---|---|---|
| 3,107,902 | 10/1963 | Calder | 299/11 |
| 3,427,811 | 2/1969 | White | 405/259.3 |
| 3,601,994 | 8/1971 | Galis | 405/288 |
| 3,650,112 | 3/1972 | Howlett et al. | 405/259.5 |
| 4,265,571 | 5/1981 | Scott | 405/259.3 |
| 4,395,161 | 7/1983 | Wilson et al. | 405/302.1 |
| 4,456,405 | 6/1984 | Galis | 405/288 |
| 4,498,816 | 2/1985 | Korpela et al. | 405/259.1 |
| 4,601,616 | 7/1986 | Barish et al. | 405/288 |
| 4,634,318 | 1/1987 | Koumal | 405/302.2 |
| 4,679,967 | 7/1987 | Hipkins et al. | 405/288 |
| 4,775,266 | 10/1988 | Seegmiller | 405/288 |
| 4,776,729 | 10/1988 | Seegmiller | 405/288 |
| 4,934,873 | 6/1990 | Calandra, Jr. | 405/288 |
| 4,946,315 | 8/1990 | Chugh et al. | 405/288 |
| 5,018,907 | 5/1991 | Chugh et al. | 405/302.1 |
| 5,259,703 | 11/1993 | Gillespie | 405/259.6 |
| 5,415,498 | 5/1995 | Seegmiller | 405/288 |
| 5,466,095 | 11/1995 | Scott | 405/302.2 |

OTHER PUBLICATIONS

C.W. Bollier, "Hydraulic Tensioning of a Birmingham Roof Truss", Jul.19–21, 1982, pp. 104–107.

C.P. Mangelsdorf, "Current Trends in Roof Truss Hardware", Jul. 19–21, 1982 pp. 108–112.

*Primary Examiner*—Tamara L. Graysay
*Assistant Examiner*—Tara L. Mayo
*Attorney, Agent, or Firm*—King and Schickli

[57] ABSTRACT

A tensioned truss system for supporting a face of a passage in a geological structure, such as a mine roof. Spaced anchors extending into the geological structure support corresponding truss transition brackets positioned adjacent the roof. The proximal end of each of the anchors is connected to the respective brackets so as to provide support and dual elongated truss members are attached to and span between the brackets for assisting in the support. The truss members are tensioned together through a driver mechanism carried by a drill head on a roof bolter machine. The driver mechanism includes a detachable drive adapter assembly having a pair of deep well or through sockets that engage rotary fasteners threaded onto one end of the truss members to apply the tension. Prior to tensioning, split wedge retainers are used to fix the other unthreaded end of the truss members. The brackets are interchangeable and include a frusto-conical bore for receiving the retainer, or which is spanned by a washer on the fastener. The drive adapter assembly is detachable from the drill head, and includes a flexible coupling and a worm gear to drive integral side by side pinion gears and deep well or through sockets for tensioning the fasteners. A color code is provided on one truss member to designate the required opposite hand thread.

20 Claims, 7 Drawing Sheets

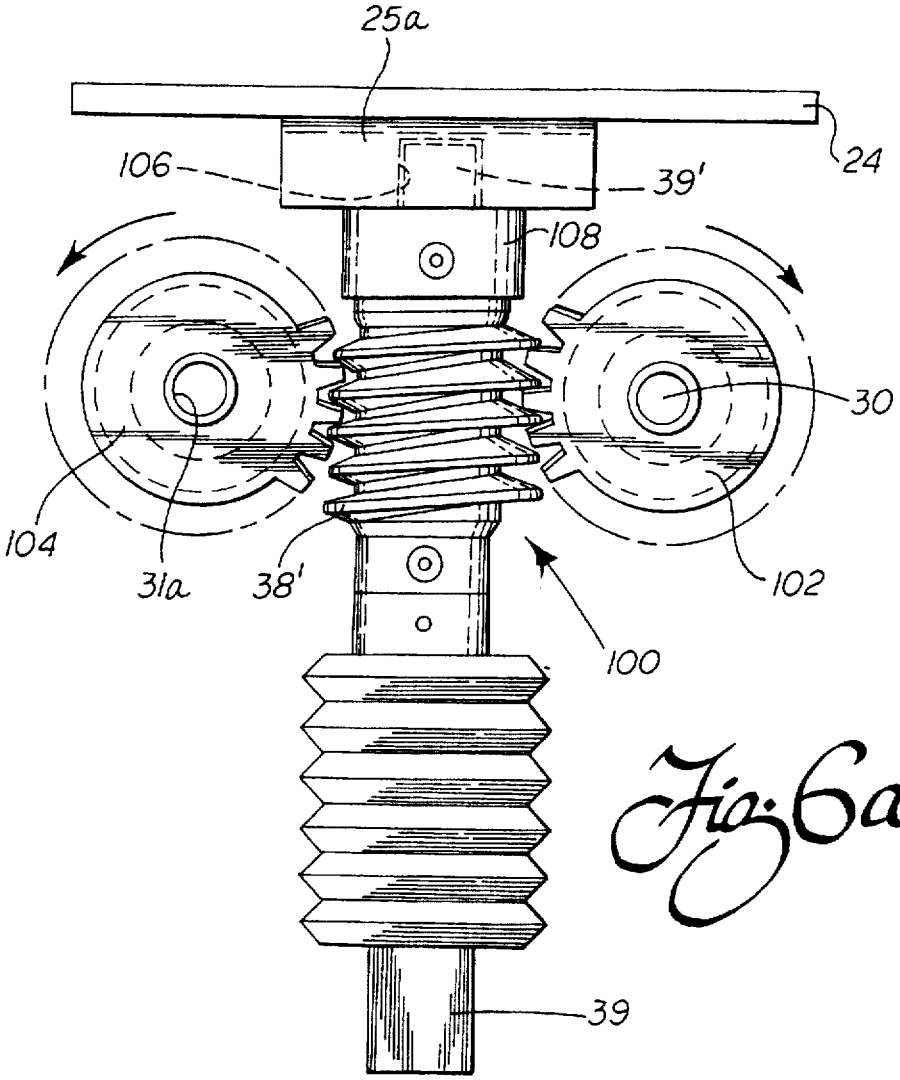
Fig. 6a
Fig. 7a
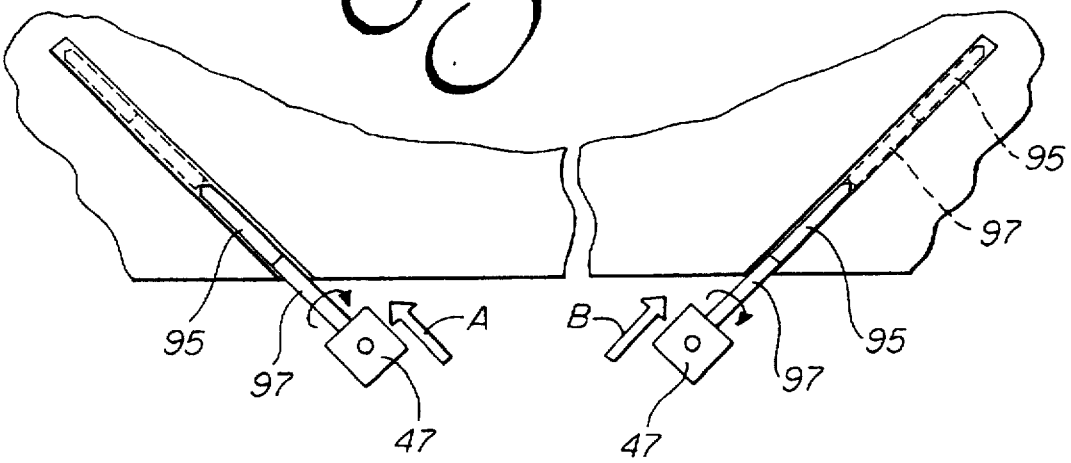

MINE ROOF TRUSS SYSTEM AND RELATED INSTALLATION METHOD

TECHNICAL FIELD

The present invention relates to a truss system for a passage in a geological structure, and more particularly, to a system and installation method for supporting the face of a passage, such as a mine roof.

BACKGROUND OF THE INVENTION

In the field of mining engineering, there have been many proposals over the years for providing effective truss support systems, particularly for mine roofs. In general, these systems include a pair of angled anchors that extend up into spaced bores in the rock above the mine passage and a horizontal member extending between the two anchors. The transition point between the anchors and the horizontal member is provided by a truss transition bracket secured in place by the anchors. Depending upon the nature of the rock forming the roof of the mine passage, and the engineer specifying the system that is needed for the particular application, the anchors may be selected as metal rods, rebar members and/or cable, each with or without an expansion unit at the distal end and/or epoxy resin in the bore for additional securing function. The horizontal truss member is then attached to the brackets and initially snugged into position by hand. Finally, utilizing either a hand tool or a hand-held power tool, the horizontal truss member is tensioned to a suitable design level, usually in the range of 15,000–25,000 pounds tension on each horizontal member.

The major two shortcomings of the prior art systems of which I am aware relate to the relatively large number of diverse parts that are required to form the truss system and the difficulty that is encountered in providing the proper tensioning. One example of a prior system that experience has proven falls into this category is the system of White, as shown in U.S. Pat. No. 3,427,811. Angled anchors and support plates are attached through pins to flexible strap or cable horizontal members, which in turn are interconnected with threaded rods and a centrally located turnbuckle. This design while functional, not only is costly to produce, but is hard to handle because of the inordinate number of parts. The tensioning process is slow since the turnbuckle, as it is turned by hand, (possibly using a transverse positioned bar to provide leverage) can be advanced only about one-half turn each time. Such a process is not only slow, but necessarily the tension can be controlled only by the feel of the installer. Furthermore, where the roof of the mine is relatively high, the installer has to be assisted by a ladder or scaffolding, which is time consuming to erect and/or to move from position to position along the length of the mine.

A later development evolving out of the White '811 system is illustrated in the Korpela et al. system, illustrated in U.S. Pat. No. 4,498,816. In the Korpela system, the transition area between the angled anchors and the horizontal rod members is made up of three separate pieces; a roof plate and two angled clips, one for connection of the anchor and one for connection of the horizontal member. The tensioning function of the horizontal members is provided by mating nuts and threads at both ends. While such an approach is theoretically an advance over the White system, as pointed out in the teaching of this patent, it is still difficult to handle the many separate parts that are required to form the complete truss system. Since there is no means for major adjustment of the horizontal truss member to varying widths between brackets, the installation is made much too tedious (exact placement of the bore holes becomes essential). Furthermore, the installer is still left with the use of a manual or powered hand tool to provide tensioning of the truss members one at a time.

An approach similar to the teaching the Korpela et al. '816 patent is found in the U.S. Pat. No. 4,934,873 to Calandra. The teaching in this reference is similar in that the angled anchors extend up into the geological structure and include a transition bracket assembly that includes an eyebolt connection for a single, multiple part horizontal member. Either rigid metal rod or a flexible wire rope cable is employed for each of two principle sections of the horizontal member. A U bolt is provided at one end of the horizontal member and a connection clip is positioned substantially in the center of this horizontal member. The tensioning operation must be carried out in the center location in a manner similar to the procedure, and with the same difficulty, as taught in the White '811 patent.

Contemporary thinking in the field of truss systems can also be illustrated by review of the Wilson et al. U.S. Pat. No. 4,395,161. The transition bracket is very similar to the one illustrated in the Korpela et al. '816 patent, having the same inherent weakness as to adjustability between brackets, and the tensioning is still limited by use of a hand tool or hand-held power tool. Finally, the Scott U.S. Pat. No. 5,466,095 perpetuates the same trend of the use of cable for the horizontal truss member, such as taught by the White '811 patent and the Calandra '873 patent, and the use of a hand-held power tool for tensioning, as taught by the earlier Wilson et al. '161 patent.

Thus, the need for a simplified, but full strength tensioned truss system that can be easily installed and tension activated is needed. While the prior art as described above, has been focused on similar designs and installation approaches, a relatively radical departure from this past is needed. The simplified system that is sorely needed should not only substantially reduce the original cost of manufacture of the system components, but should reduce the time and effort needed for installation and tensioning, as well as provide better control of the amount of tension applied. Taken together, all of the features need to be designed to not only provide full strength and effectiveness for support of the geological structure on which it is applied, but to also make the work easier and more productive for the installers.

SUMMARY OF THE INVENTION

Accordingly, it is a primary object of the present invention to provide a tensioned truss and installation system for supporting a face, such as a mine roof, of a passage in a geological structure in a manner to overcome the many shortcomings of the prior art systems.

Another object of the present invention is to provide a tensioned truss system that includes spaced anchors, transition brackets and elongated truss members spanning between the brackets interconnected and tensioned by simple method steps in order to provide a more efficient and easier to install system.

It is still another object of the present invention to provide a truss system of the type described, and a related installation method wherein the tensioning of the horizontal member does not require a manual operation.

It is a related object of the present invention to provide a tensioned truss and installation system wherein the tensioning operation is performed in a preferred manner by use of a roof bolter machine.

It is still another related object of the present invention to be able to drill the bore hole for the anchor of the truss system and to tension the horizontal truss member or members by use of the same roof bolter machine, whereby the truss system can be rapidly and efficiently installed, as well as tension activated.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved truss and installation system is provided for supporting a face of a passage, such as a roof, in a geological structure. The system comprises first and second spaced anchors extending into the geological structure, with the proximal end extending into the passage, and transition brackets positioned adjacent the face and connected to the proximal end of the anchors. One or more elongated truss members are attached to and span between the brackets, and means for controllably tensioning the truss member(s) is provided. The tensioning means for the truss member(s) includes a driver mechanism carried by a lifter means, which in turn is supported on another face of the passage, such as on the floor in the instance where the truss system is installed on the roof of the mine.

Within the broadest aspects of the present invention, the driver mechanism employs either a rotary drive or a linear drive, depending on the type of fastener utilized to tension the truss member(s). In either instance, the need for manual handling of the driver mechanism, that has plagued the installation and tension activation of the truss system in the past, is eliminated. Not only is the tensioning simplified and easier for the installers, but also provides for substantial cost savings in terms of initial cost of the components, as well as minimizing time spent during installation and tension activation.

Preferably, the tensioning means includes a rotary fastener for engaging a mating part on the horizontal truss member. In such an instance, another feature of the present invention is to provide the driving force for the fastener by direct coupling to the operative drill head of a bolter machine, such as the same bolter machine that installs the anchors of the truss system. The preferred rotary fastener is a nut, either with a hex or square circumferential driving face, and mating with threads on the truss member. The lifter means for positioning the drill head to carry out its rotating function comprises the articulated/pivoting support linkage/arms that are built into the standard bolter machines.

Also, in accordance with the preferred installation system, the tensioning is performed by use of the fastener only at one end of the truss member. The second end of the truss member is preferably unthreaded and initially snugged and held in position by a split wedge retainer fitted in a frusto-conical bore in the adjacent bracket, prior to the tensioning operation.

In order to most efficiently carry out driving of the rotary fastener, a detachable drive adapter assembly is coupled to the rotary drill head of the bolter machine. The adapter assembly includes at least one deep well socket or through socket for engaging the fastener. A pinion gear rotates the socket, and a worm connected through a flexible coupler and adapter shaft, receives its driving power from the drill head. The position of the drive adapter assembly is infinitely adjustable through manipulation of the drill head, including in all planes of movement, through the existing hydraulic power circuit and operating actuators of the roof bolter machine.

In accordance with another advantageous feature of the truss system is, horizontal truss members are employed with a nut, or other rotary fastener, for tensioning on each member. The drive adapter assembly includes in this instance a pair of sockets so as to provide the capability of substantially simultaneous tensioning of the truss members. In this regard, the deep well or through socket of the adapter assembly and the pinion gears are integrally connected and supported for rotation. The worm gear for driving the gears is positioned between the two pinions. Thus, the sockets are driven in opposite directions, with one of the truss members being color coded to indicate the opposite hand rotation to the other. In an alternative arrangement, utilizing a miter gear subcombination and dual, opposite threaded worm/pinion gears, the truss members/fasteners may be threaded in the same direction and the color coding eliminated. Still yet another alternative arrangement is a direct drive assembly is provided wherein a worm gear is utilized for tightening gear nuts which are threaded directly upon the truss members.

In accordance with the related method of installing and tension activating the truss system of the present invention, and as briefly mentioned above, one of the primary advantageous features is to employ a driver mechanism that includes the operative drill head of a bolter machine. As described above, the truss system utilizing this advanced installation/tensioning method also employs spaced transition brackets supported by anchors in the geological structure and at least one truss member extending between the brackets. As before, while any face of a passage in the structure can be advantageously supported, the method is particularly adapted for supporting the roof of the passage, such as a mine shaft. In one of its simplest forms, the steps of the method include lifting the driver mechanism on the bolter machine into position adjacent the corresponding transition bracket, engaging the fastener that provides the tensioning of the truss member and then tensioning the truss member by operation of the driver mechanism. It will be realized by those of skill in the art that through this simple, but highly advantageous change in the standard prior art installation/tension activation procedure, a much more efficient, accurate and reliable truss system for a mine roof is obtained.

Providing additional benefit from the installation/tension activation method of the present invention, the same roof bolter machine is used for initially drilling the spaced bores in the geological structure for receiving the anchors. The anchors, preferably angled inwardly toward the proximal ends, are positioned through the brackets at an angle for easy placement within the bores.

The anchors, with attached brackets, are guided into the bore holes and pushed to the top or back of said bore holes, securing the anchors within the roof mass and the brackets against the mine roof. The horizontal truss members are then placed through the frusto-conical bores of both brackets. The split wedge retainers are snugged into position within one of the brackets, while the fasteners (nuts) are threaded onto the threaded ends of the horizontal truss members outside the frusto-conical bores of the other bracket. The driver mechanism of the bolter machine is then lifted into engagement with the assembly to tighten the fasteners to tension the truss members. This compresses the overburden rock and provides mine roof uplift, as desired. In this manner, the overall installation/tension activation of the truss member is most efficiently carried out.

A standard feature of the method portion of the present invention just described is fixing one end of the truss member by employing the split wedge retainer. In accordance with standard practice, the split wedge retainer is snugged into position in a tapered or frusto-conical bore. This action securely holds the unthreaded rod or cable end as the tensioning step using the threaded rod/cable and nut at the opposite end proceeds. The level of tension applied to the truss member(s) is regulated and limited by the built-in torque control or limiting feature of the drill head as the nut(s) are tightened, such as by a hydraulic pressure bypass system.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention and together with the description serves to explain the principles of the invention. In the drawings:

FIG. 6*a* is a side view showing the placement of the direct drive assembly in position for cooperation between the worm gear and gear nuts to tension the truss members; and FIGS. 7*a*–7*d* are sequential schematic illustrations of the overall system of providing truss support for a mine roof in accordance with the present invention.

Reference will now be made in detail to the present preferred embodiment of the invention, an example of which, along with alternative subcombinations, are illustrated in the accompanying drawings.

DETAILED DESCRIPTION OF THE PREFERRED EMBODIMENT

Figure 1:
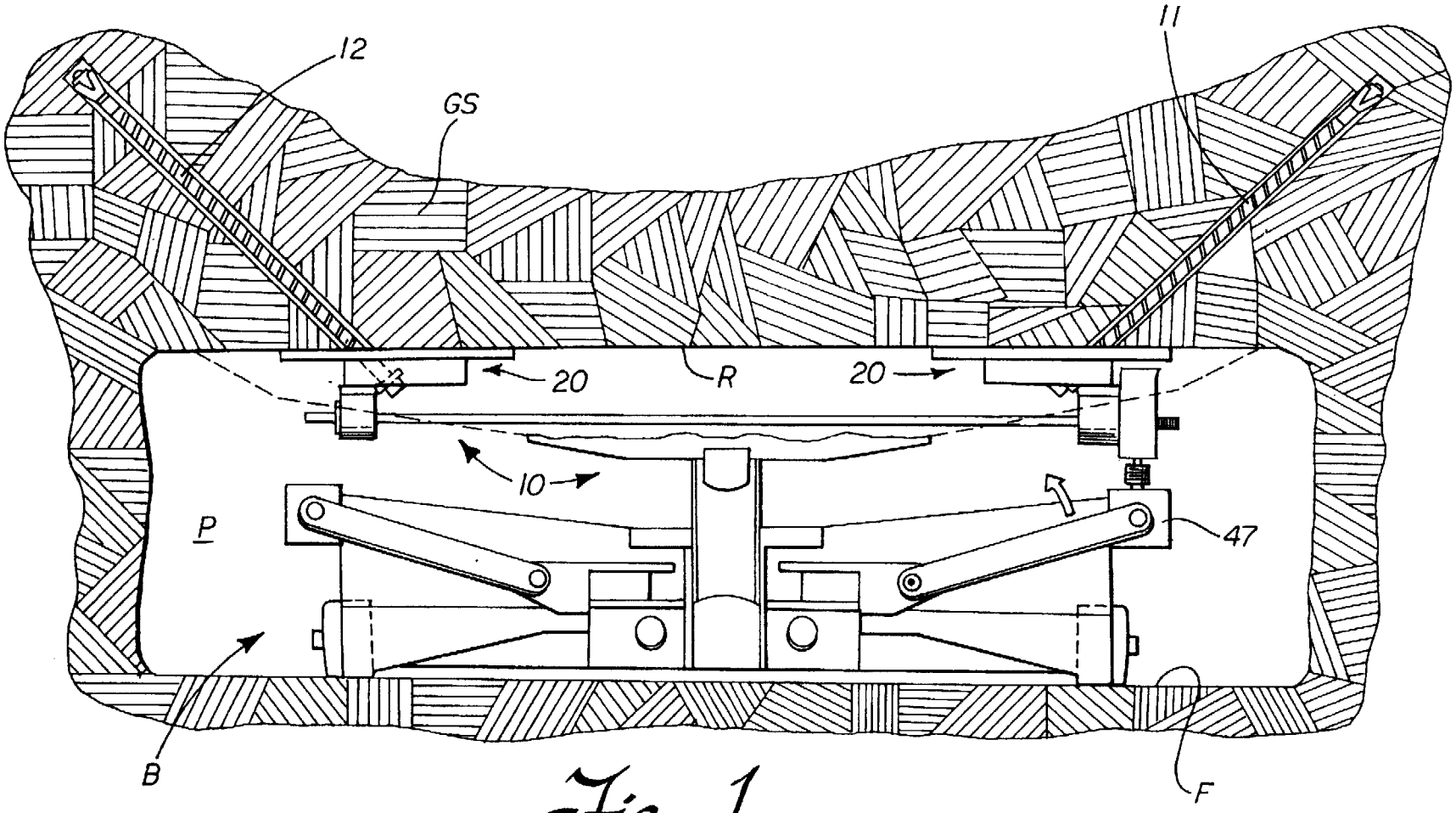
FIG. 1 is an overall front, schematic view of the tensioned truss and installation system of the present invention presented in the environment of a mine passage for supporting the mine roof.

With reference now to FIG. 1, there is shown a front view of a tensioned truss and installation system of the present invention, as it is contemplated as being used in its preferred form at the present time. As illustrated, a bolter machine, generally designated by the reference indicia B, is positioned in a passage P within a geological structure GS, such as a mine.

Typically, the structure GS comprises an overburden of rock, such as sandstone and/or limestone and typically the passage P is an area that has been mined of coal, or other natural resource. Thus, while the system of the present invention is being illustrated, and will be described with regard to reinforcement and sustaining the mine roof R, it will be understood that in accordance with the broadest aspects of the present invention, it can be applied to any one of the other faces within the passage P. Also, the system and the implementing installation method is useful in its broadest aspects for reinforcement of any other face of a closed or open passage, such as for shoring the vertical side walls.

Figures 2, 3B:
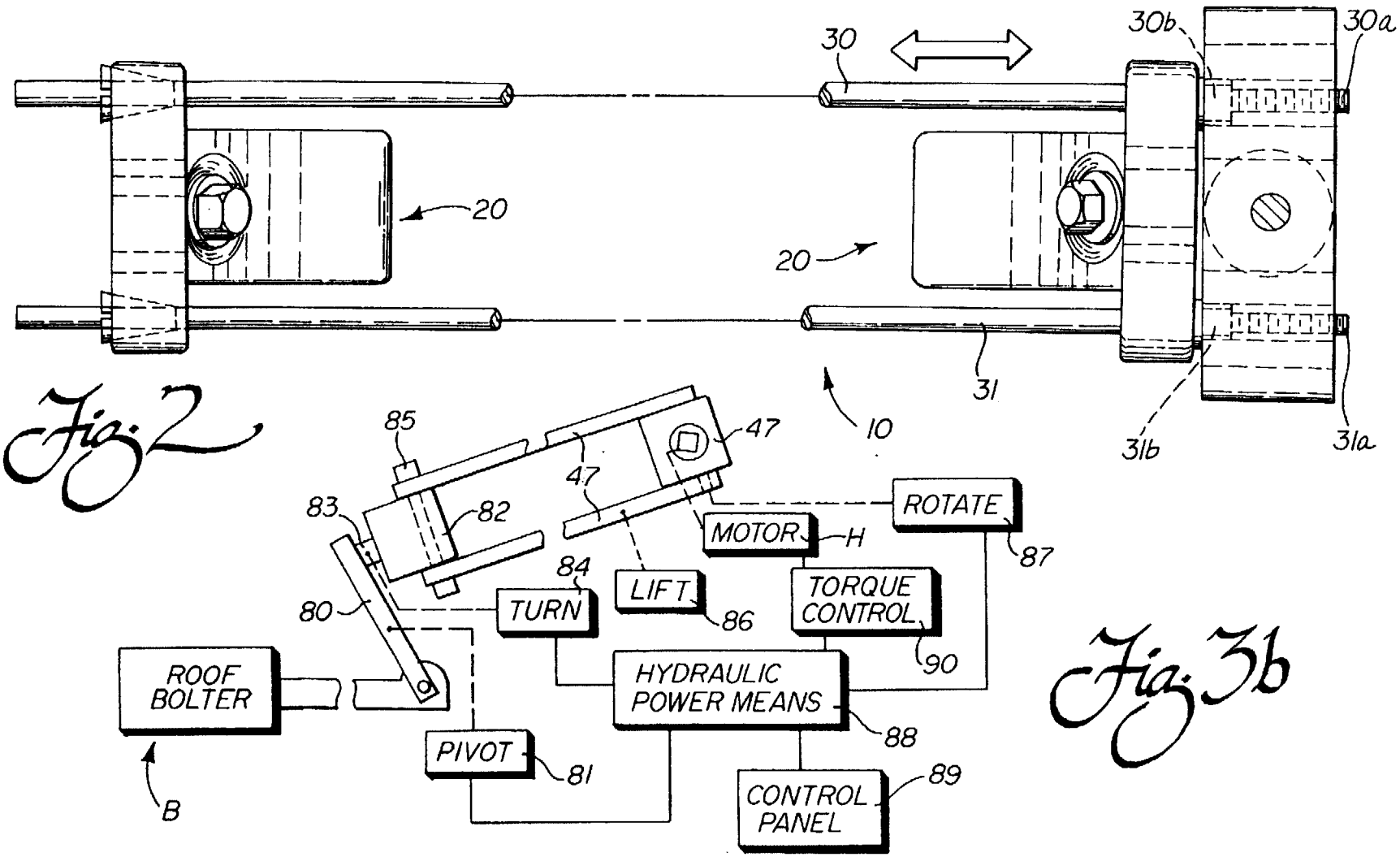
FIG. 2 is a cut away, upward plan view of the visible portion of the tensioned truss system of the present invention when used for mine roof support, and with some components broken away and removed for clarity.
FIG. 3*b* is a schematic diagram of the support linkage assembly and hydraulic control system of the roof bolter machine used for positioning the drill head for infinite adjustment in all planes.

Thus, with respect to the front view of FIG. 1, and with the assistance of the illustration in FIG. 2, a truss system, generally designated by the reference numeral 10 is provided and comprises first and second spaced anchors or roof bolts 11, 12 extending into angled bores in the geological structure GS. The anchors 11, 12 are shown strictly for illustrative purposes as being at an approximately 45° angle and slanting inwardly with respect to the passage P. As is well known, the anchors 11, 12 when appropriately positioned and tensioned in the manner shown, serve to reinforce the mine roof R. The roof bolter machine B may be of any suitable design, such as the Dual Head Model DDR-13 C-F of the J. M. Fletcher & Co. of Huntington, W. Va. However, other bolters are equally useful insofar as the operative drill head D can be adjusted both vertically and angularly with respect to the roof R.

Figure 3:
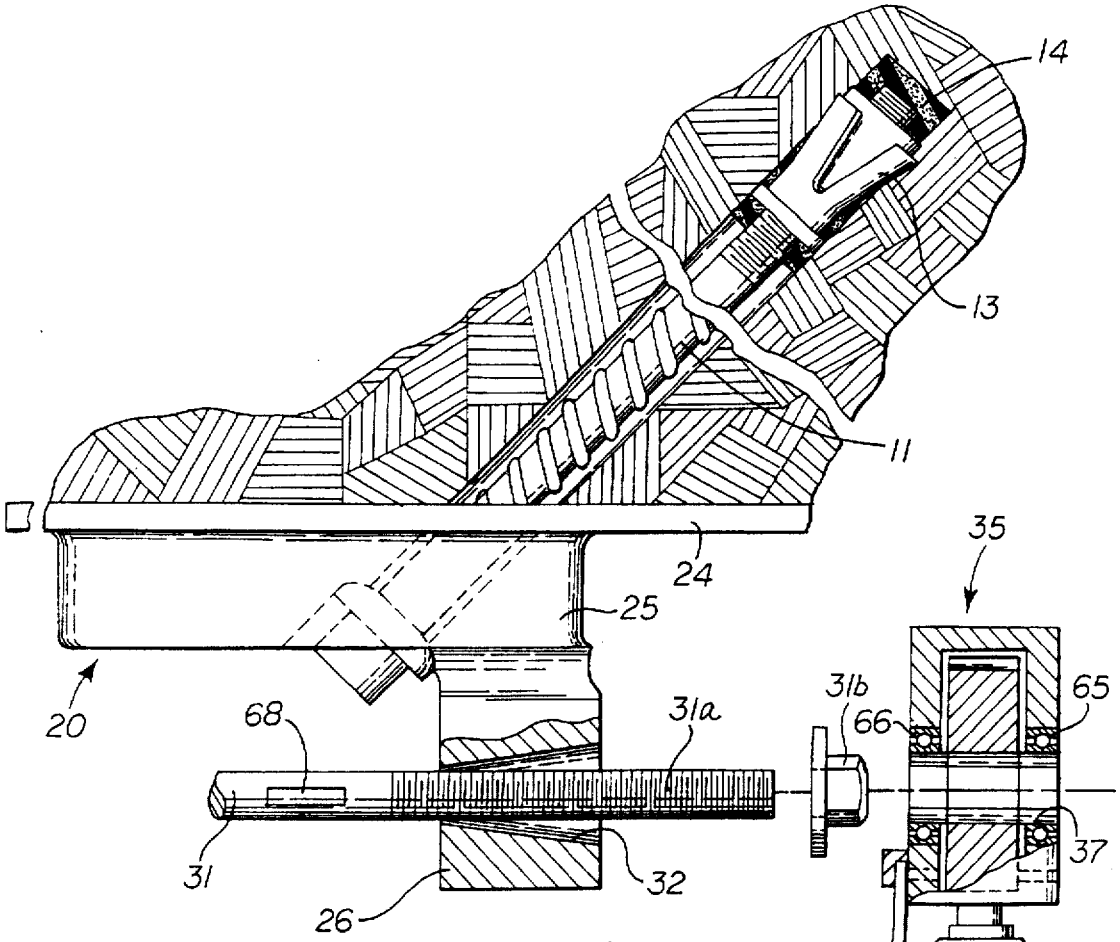
FIG. 3 is an enlarged side view in partial cross section, also with portions of components broken away for clarity, and illustrating a first anchor connected to a corresponding first truss transition bracket and receiving one end of the truss member, and further with the fastener, drive adapter assembly and operative drill head of the roof bolter machine being included but separated for clarity.

With reference now to FIGS. 1 and 3, a more detailed view of the first anchor or roof bolt 11 can be seen, and it includes an expansion unit 13 which may be positioned within epoxy resin 14, if desired. The roof bolt 12 can be considered to be the same. In many instances, and within the broader aspects of the present invention, the roof bolts 11, 12 can comprise other standard arrangements, such as simply a rebar rod and epoxy.

The truss system 10 of the present invention also includes first and second truss transition brackets 20 positioned adjacent the mine roof R as illustrated, the proximal end of each of the anchors or roof bolts 11, 12 extending down through the respective bracket 20 and fixed in place against the roof R in the usual manner.

The transition bracket 20 includes a face plate 24, a base 25 and a depending cross piece 26. Preferably, each bracket 20 is fabricated of high strength steel, with the base 25 and the cross piece 26 preferably being cast and the face plate 24 being a graded, rolled steel plate. To minimize the number of component parts and as one of the features of the present invention, the plate 24 is welded to the base 25 so that it can be handled as a single piece. Also, it is important to emphasize that the bracket 20 is interchangeable so as to be used at either end and thus provide additional efficiency in the initial cost of the system. Additionally, the length of the base 25 may vary to accommodate the use of alternative tensioning means, as will be described in greater detail below.

To complete the truss system 10 of the preferred form of the invention, dual, elongated truss members 30, 31 are attached to and span between the first and second truss transition brackets 20. This is best shown in FIG. 2 of the drawings, and also in FIG. 3. At the first end, the truss members 30, 31 include a threaded section 30*a*, 31*a*, respectively. Cooperating with these threaded sections are corresponding fasteners in the form of, for example, flange nuts 30*b* and 31*b*.

As will be apparent, the substantially simultaneous tightening of these nuts 30*b*, 31*b* is operative to provide accurate and controlled tension in the corresponding dual truss members 30, 31 (see action arrow in FIG. 2). As explained in more detail in the discussion below with regard to the related installation method, the threaded portions 30*a*, 31*a* pass through a frusto-conical bore 32 in making the connection with the cross piece 26 of the first bracket 20. As illustrated, each nut 30*b*, 31*b* includes a flange to span the opening of the bore 32, thus providing the necessary reaction face along the outside of the cross piece 26 to provide the tensioning action.

The tensioning means for the truss members 30, 31 includes a drive adapter assembly 35 that preferably includes two deep well or through sockets 36, 37, which are driven by corresponding pinion gears 36*a*, 37*a*, and that are in turn simultaneously rotated by a single worm gear 38. An input shaft 39 (see FIG. 5) drives the gear 38. A flexible coupling 40, preferably in the form of a universal joint protected by a rubber, accordion style boot, allows some variation in the angle of engagement with the nuts 30*b*, 31*b* that are being driven. Also, if necessary or desired for additional stability a flexible locating and torque resisting pin 41 can be provided on the adapter assembly 35 for mating with a recess in the head 47 (see FIGS. 3, 3*a*).

Figure 3A:
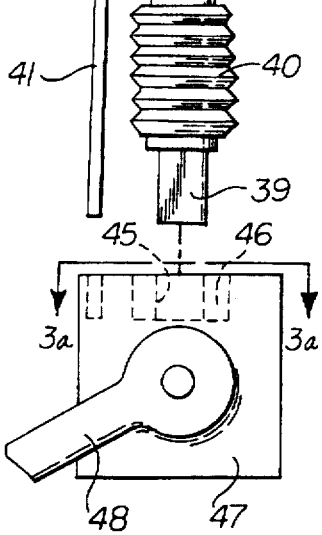
FIG. 3*a* is a top view of the drill head taken along line 3*a*—3*a* of FIG. 3 and showing the hydraulic drive motor.
Figure 3A:
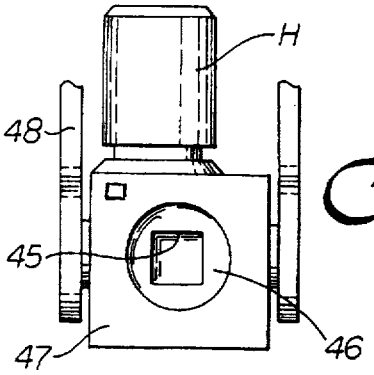

The torque for the input shaft is provided in accordance with the invention through a socket 45 formed in spindle 46 of the operative drill head 47. It is an integral part of the bolter machine B. This is best illustrated in FIG. 3*a*, which also illustrates a suitable hydraulic motor H to provide the rotary power for the socket.

Advantageously, the drill head 47 is supported for lifting into position by a pair of lifter arms 48. These arms are supported by a linkage assembly of the bolter machine B, and operated by hydraulic cylinders, as generally represented in FIG. 3*b*, and as will be described in detail later. The lifter arms 48 are thus indirectly supported from the floor F of the passage P, and accordingly require no hand lifting and manipulation by the installers of the truss system 10. In other types of modern roof bolters, the lifting action can be accomplished by more direct hydraulic cylinder connection to the head 47, stabilized by telescoping type guide members. In any case, a more efficient and reliable truss system can be provided without fatigue of the installers being a problem. Equally important is the fact that the system 10 is simplified, and yet is capable of providing full strength and effectiveness for consistent mine roof compression and uplift.

As will be comprehended by those of skill in the art, the truss members 30, 31 can be either metal rods or cables, depending upon the particular application of the truss support system 10. Also in accordance with the broadest aspects of the present invention, the tension can be applied either by the direct rotary action of the nuts 30*b*, 31*b* on the threaded rod or cable, or by linear jacking devices powered by rotary action, for example. In any case, the hydraulic drive motor H, which is also used for drilling the angled bores for the anchors 11, 12 advantageously has more than sufficient torque and control to carry out the tensioning operation.

Figure 4:
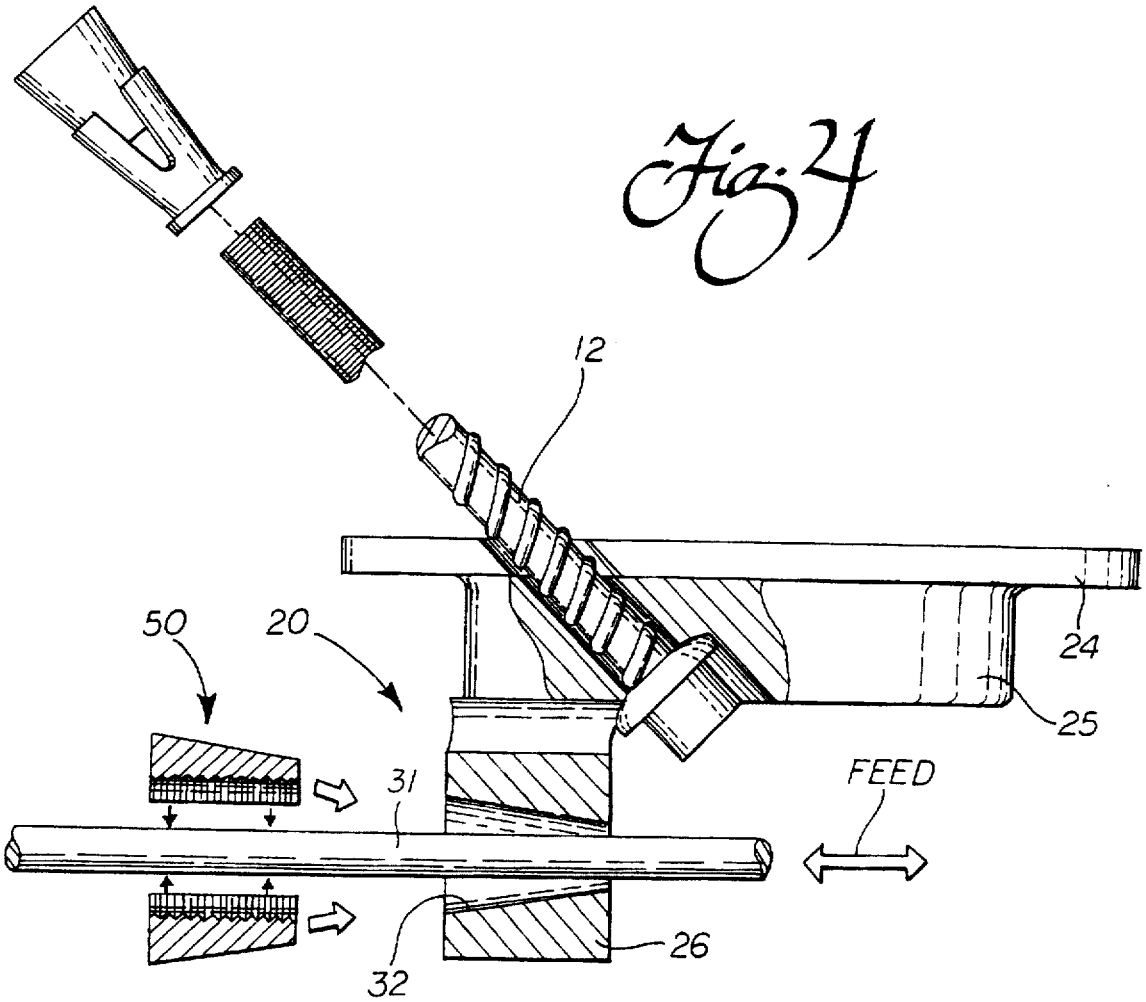
FIG. 4 is an enlarged cross section and broken away view of the second anchor at the second or opposite end of the truss member and illustrating the nature of retention by the split wedge retainer.

With reference now to FIG. 4 of the drawings, the second end of the truss member 31 is illustrated passing through the frusto-conical bore 32 of the identical truss transition bracket 20 associated with the second anchor 12. In order to provide the most efficient connection of this end, which preferably is unthreaded, a split wedge retainer 50 is used. Thus, after the assembly operation, but prior to tensioning the members 30, 31 by operation of the driver mechanism of FIG. 3, the two halves of the retainer 50 are simply moved in unison toward the end of the rod 31 and up to the frusto-conical bore 32. This is shown with the appropriate action arrows of FIG. 4. The rod 31 is then moved through the bore 32 at the same time that the retainer halves 50 are being placed and fed forward and snugged into position. The flanged fasteners or nuts 30*b*, 31*b*, which have been previously threaded onto the respective threaded portions, are next brought up and snugged into engagement with the reaction face of the cross piece 26 on the first truss transition bracket 20 (see FIG. 3). This action provides the width adjustment and major take-up of the horizontal truss members that is lacking in many of the trusses that are available today, as noted in the truss art discussions earlier. Additionally, the subsequent take up by rotation of the nuts 30*b*, 31*b* during final tensioning is minimized.

To explain the tensioning of the truss system 10, including the truss members 30, 31 in more detail, reference is made to FIGS. 7*a*–7*d*.

With the anchors 11, 12 set in the bore holes (see FIG. 7*b*), and the transition brackets 20 and truss members 30, 31 in place and the retainer 50 and nuts 30*b*, 31*b* snugged, the head 47 and the drive adapter assembly 35 are raised into position and hydraulic power applied for tightening the nuts. The resulting tensioning draws the truss system 10 together and compresses and lifts the overburden rock, as indicated by directional arrow E (see FIG. 7*c*). This action also draws the anchor bolts 11, 12 firmly against the bore walls as indicated by action arrows F and G, respectively (see FIG. 7*c*).

With reference back to FIG. 5 of the drawings, a more complete description of the manner in which the preferred drive adapter assembly 35 of the present invention is constructed can be explained. The input shaft 39 receiving the driving torque from the drive motor H (not shown) through the socket 45 is mounted in bottom and top bearings 60, 61 within housing 62. Dust seals 60*a*, 61*a* are provided on the shaft 39 external to the housing 62. The flexible coupling 40 can take the form of a standard universal joint or the like, which in turn is protected by the accordion boot, as illustrated. The flexible locating pin 41 not only prevents the bodily rotation of the housing 62 during application of the torque to the shaft 39, but also allows the flexing motion so as to accommodate any slight misalignment when the sockets 36, 37 are brought into engagement with the nuts 30*b*, 31*b*.

As will be apparent, since the pinion gears 36*a*, 37*a* engage the same worm gear 38 on opposite sides, the sockets 36, 37 necessarily rotate in the opposite direction. For example, assuming that the hydraulic drive motor H rotates the spindle 46 in a left hand or counterclockwise direction, the socket 37 will also rotate in a counterclockwise direction. Conversely, the socket 36 will rotate in a clockwise direction (see action arrows in FIG. 5). As illustrated in FIG. 3, the sockets/pinion gears 36, 36*a* and 37, 37*a* are preferably integrally supported on suitable sealed bearings 65, 66.

In order to provide the proper tensioning using these counter rotating sockets 36, 37, the truss members 30, 31 are oppositely threaded. A color code, which can take the form of a defined patch or general color sprayed area, as designated by the reference numeral 68, is employed to alert the installer to the proper side of the brackets for the two differently threaded members. As set forth in the preferred embodiment shown in the drawings, the color code 68 designates a left hand thread. For tensioning, counterclockwise rotation of the nut 31*b* on the threaded portion 31*a* of the truss member 31 is necessary. As will be apparent, the nut 30*b* on the right hand threaded section 30*a* is rotated in the clockwise direction for tensioning.

Figure 5A:
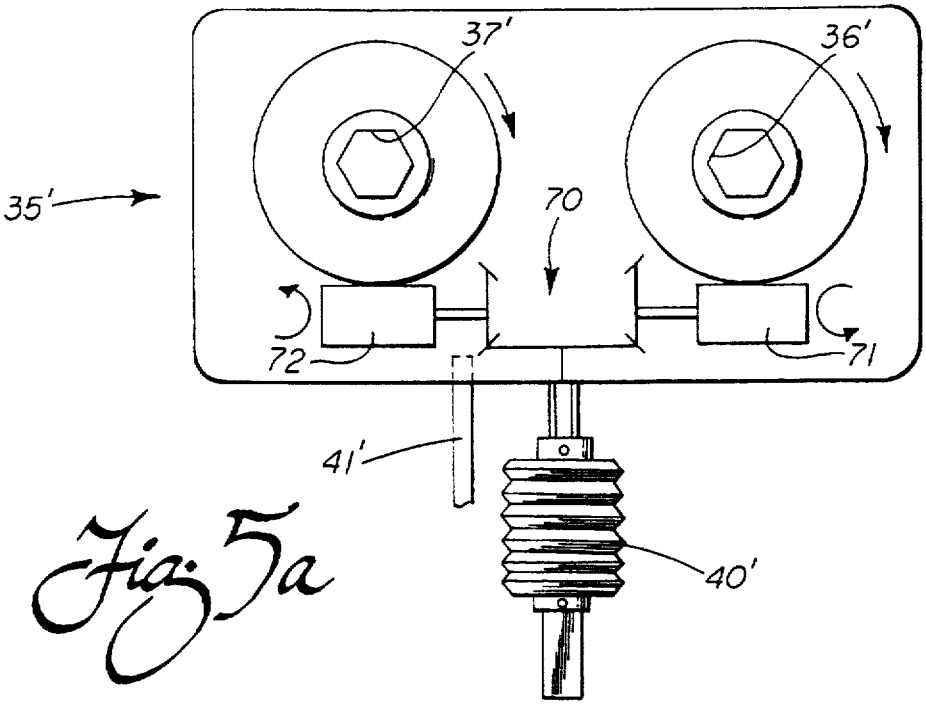
FIG. 5*a* is a schematic diagram of an alternative drive adapter assembly including a bevel gear subcombination, counter-rotating worm gears and integral pinion gears/sockets for tensioning of the fasteners.
Figure 5:
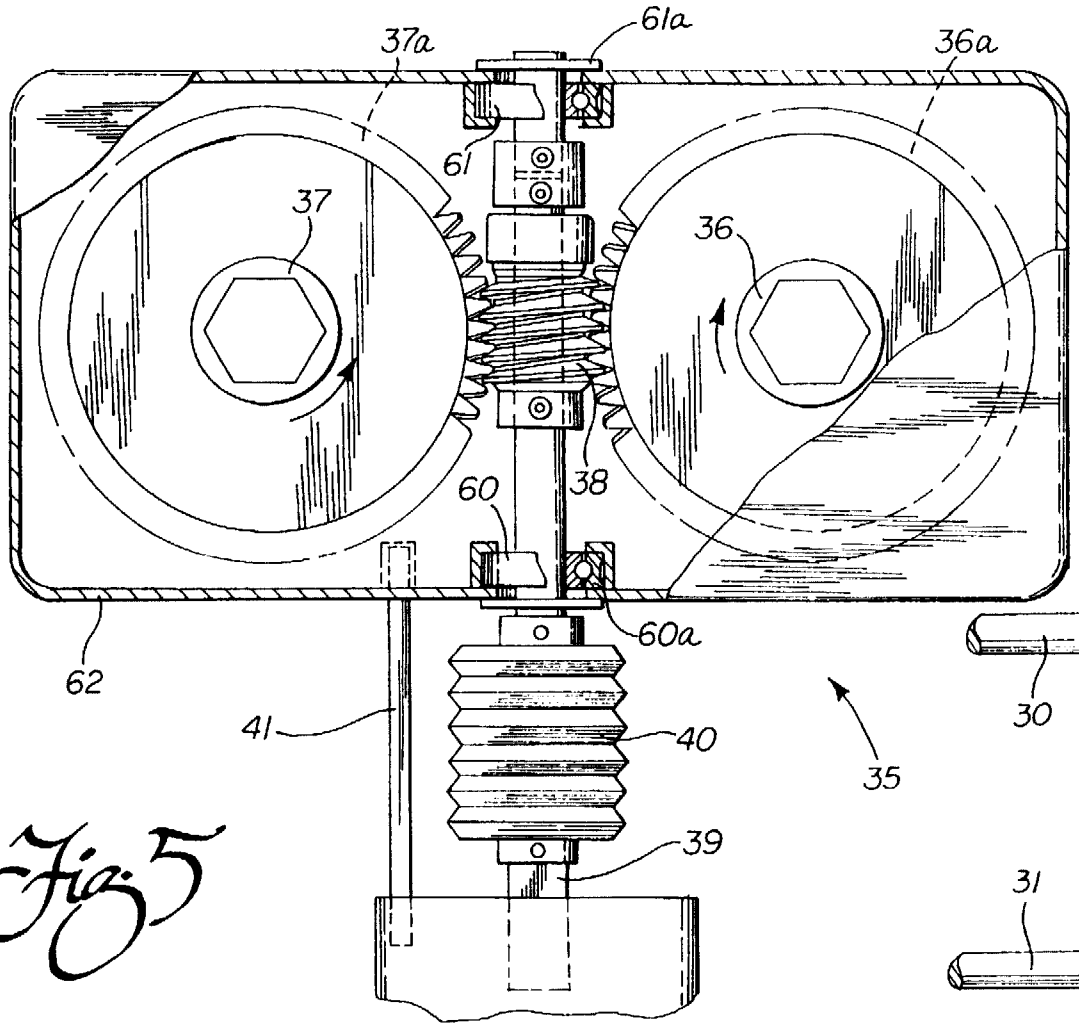
FIG. 5 is a front view of the drive adapter assembly, with portions cut away for clarity and illustrating the counter-rotating deep well or through sockets for engaging and tensioning rotary fasteners, such as flange hex or square nuts.
Figure 7B:
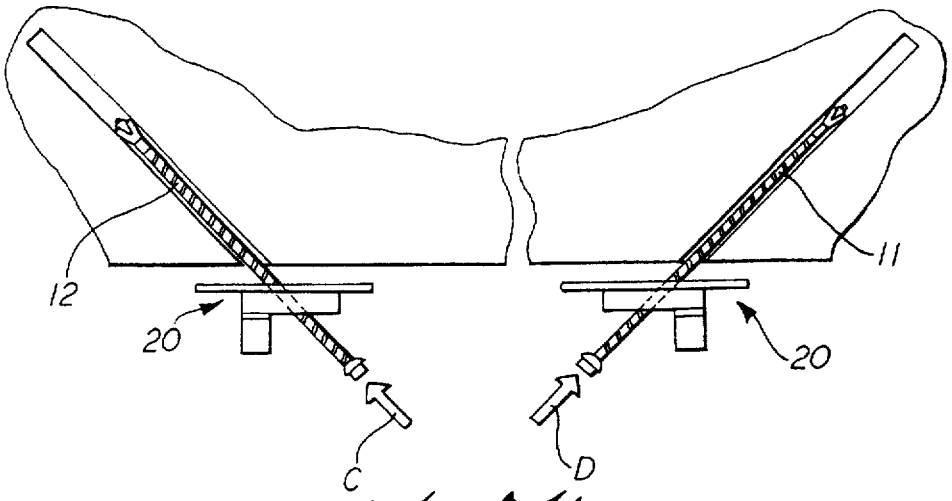
Figure 7C:
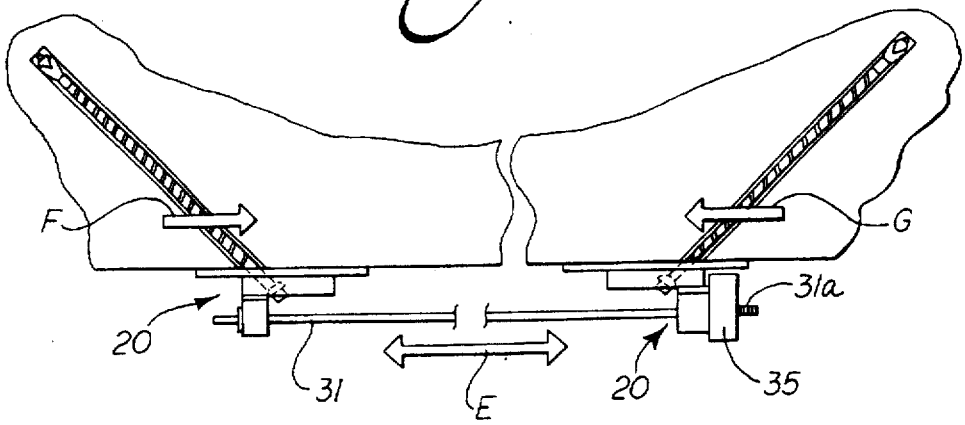
Figure 7D:
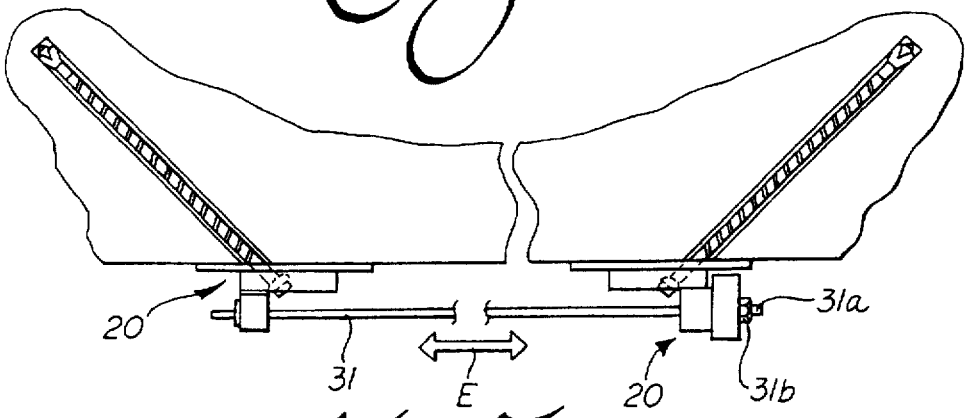

An alternative drive adapter assembly 35' is illustrated in schematic form in FIG. 5*a*. As illustrated, a pair of integral deep well or through sockets/gears 36', 36*a'* and 37', 37*a'* both now rotate in the clockwise or right hand direction. This is accomplished by providing a dual miter gear drive 70 rotating oppositely threaded separate worm gears 71, 72. In this manner, both threaded portions 30*a*, 31*a* can be provided with right hand threads and no color coding is necessary.

Advantageously, the support linkage for the drill head 47 allows full adjustability so that the sockets 36, 37 can be quickly and accurately aligned with the nuts 30*b*, 31*b* for tensioning. A representative linkage, actuator and control circuit is illustrated in FIG. 3*b*. From the frame of the bolter machine B, pivot arm 80 can be moved by a suitable pivot actuator 81; a mount 82 carried by a shaft 83 on the arm 80 can be articulated by a turn actuator 84; the lifter arms 48 mounted on shaft 85 are lifted up and down by lift actuator 86; and the drill head 47 is pivoted on the mounting trunions by a rotary actuator 87. Each of the actuators 81, 84, 86 and 87 are preferably hydraulic cylinders/motors and are provided with hydraulic pressure from a central hydraulic power means 88, which in turn is controlled by the installer on the bolter machine B through a control panel 89. The hydraulic power means also drives the hydraulic motor H through a torque control 90 in a manner to assure full tensioning, but not over-tensioning of the truss members 30, 31.

Figure 6:
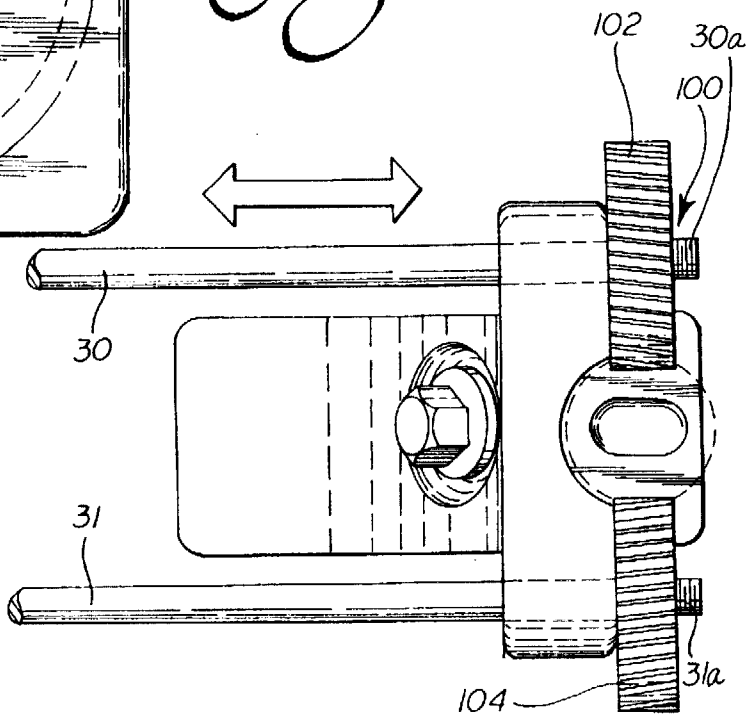
FIG. 6 is a partial upward plan view of the tensioned truss system illustrating the positioning of an alternative drive means referred to as a direct drive assembly for providing the tensioning.

Another alternative tensioning means (in addition to the drive adapter assemblies 35 or 35' as described herein) for the truss members 30, 31 includes a direct drive assembly 100, as illustrated in FIGS. 6 and 6*a*. The direct drive assembly 100 preferably includes two gear nuts 102, 104 which are threaded upon threaded portions 30*a*, 31*a* respectively, and are in turn simultaneously rotated by worm gear 38'. Worm gear 38' is driven through input shaft 39 and flexible coupling 40 in response to rotation of the socket 45 of drill head 47, as explained in more detail above. As with the drive adapter assembly 35, worm gear 38' causes the gear nuts 102, 104 to be rotated in the opposite direction so that color coding of the truss member 31 is required.

Preferably, the gear nuts 102, 104 are brought into snug engagement with the reaction face of the cross piece 26 so that rotation of the gear nuts is minimized and tensioning of the members 30, 31 is initiated immediately upon rotation of said gear nuts. The worm gear 38' is initially positioned for engagement with gear nuts 102, 104 by raising the drill head 47 straight up so as to position the initial thread of the worm with the lowermost teeth of the gears 102, 104 along the upward path of movement.

As the worm gear 38' is now rotated, it engages more of the gear nuts 102, 104 and proceeds upward rotating the gear nuts until they are fully snugged in place. Finally, the distal stub 39' of shaft 39 is received in the slotted receptacle 106, whereupon the end of the stub and the collar 108 are abutted in the base extension 25*a*. The head 47 and the worm gear 38' continue to apply pressure through the lifting action. The worm gear 38' is actually tending to lift itself by its driving action firmly against the now tightened gear nuts 102, 104 until the stub 39' bottoms into the receptacle 106. As the nuts are tightened, the stub 39' can move inwardly toward the cross piece 26 to follow the gear nuts if necessary. The slotted receptacle 106 also provides for some leeway in placement of the worm gear in order to further expedite the installation process.

The gear nuts 102, 104 are fully tightened by the continuing rotation under pressure of worm gear 38'. Once the gear nuts 102, 104 are sufficiently tightened to obtain the desired tension on truss members 30, 31, the application of pressure is stopped through the torque control 90. The worm gear 38' can now be counter-rotated and so as to remove itself from engagement with the gear nuts 102, 104 while the gear nuts remain firmly in position.

Advantageously, the receptacle 106, as best shown in FIG. 6*a*, provides a means for supporting the distal stub 39', which in turn is responsible for centering the worm gear 38' between the gear nuts 102, 104. This action ensures that the torquing action provided by the direct drive assembly 100 is uniform and consistent. In addition, a recess 108 (see FIG. 6*a*) is provided in cross piece 26 so that the limit of movement of the worm gear 38' remains within the range of proper engagement between the gear nuts 102, 104 as the tightening/tensioning is carried out.

The preferred method of installing and tension activating the truss system 10 of the present invention can now be more fully explained with reference to schematic FIGS. 7*a*–7*d*. As described above, the bolter machine B includes the capability of lifting the operative drill head 47 into position with respect to the roof R for drilling the bores for the anchors 11, 12 and for tensioning the truss members 30, 31 and the anchors 11, 12 in a unique fashion.

Specifically, the installers operating the bolter machine B first provide drill bits 95 and extensions 97 (see FIG. 7*a* and arrows A, B) mounted in the drill heads 47 for substantially simultaneously drilling on both sides. The drill bits 95 are moved upwardly on both sides by adding extensions until the bores are fully formed (see dotted line positions).

The next step is provided by preassembling the truss assembly 10. To do this the anchors 11, 12 are partially extended through the transition brackets with the distal end positioned at about a 45° angle to the brackets 20. The brackets 20 are lifted into position with the anchor bolts 11, 12 being directed into angled bores (see FIG. 7*b* and arrows C, D) and secured against the roof R using the expansion unit 13 and/or the epoxy resin 14. Next, in accordance with the concepts of the present invention, the split retainers 50 and nuts 30*b*, 31*b* are positioned on the truss members 30, 31 and snugged in turn against the respective brackets 20. The drive adapter assembly 35 shown in FIG. 3, or one of the equivalent mechanisms, is then lifted into position by the drive head 47 and lifter arms 48 so as to provide alignment of the sockets 36, 37 with the nuts 30*b*, 31*b*. By use of the control panel 89 operating the actuators 81, 84, 86 and 87, the installer can quickly and efficiently place the drive adapter assembly 35 into position and the motor H can be actuated for tensioning (see action arrows E, F, G in FIG. 7*c*).

Advantageously, the method steps can thus all be accomplished without leaving the bolter machine canopy or command position. The installer is not subjected to having to lift, position and actuate a heavy power tool. The tensioning no longer involves movement to the center, or other location in the passage P, climbing to reach a turnbuckle or other device or having to work in cramped quarters. The installers are more productive and fatigue is no longer a factor. Once the nuts 30*b*, 31*b* are fully torqued, the torque control 90 of the drill head 47 is effective to terminate any further rotation and tensioning.

In summary, the results and advantages of the truss system 10 and related installation method of the present invention can now be fully understood and appreciated. The face of a passage, such as a mine roof R, in a geological structure GS can now be secured by the truss system 10 that is installed and fully activated in a highly efficient manner. Advantageously, consistent mine roof compression and uplift can be easily accomplished with the guess work eliminated. The disadvantages of the prior art systems that required an excessive number of components and hand tools for tensioning of the truss members 30, 31 have now been overcome. Full strength and effectiveness of the truss system 10 of the present invention can thus be accomplished while providing an easier and more productive installation and tension activating method for the installers.

The foregoing description of a preferred embodiment of the invention at the time of filing this application is being presented for purposes of illustration and description. It is not intended to be exhaustive or to limit the invention to the precise form disclosed. Obvious modifications or variations, such as with respect to the equivalent drive adapter assembly 35', direct drive assembly 100 and others, are possible in light of the above teachings. The preferred embodiment was chosen and described however to provide the best present illustration of the principles of the invention and its practical application. One objective of this approach is to enable one of ordinary skill in the art to best utilize the invention, and to do so in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A tensioned truss and installation system for supporting a face of a passage in a geological structure including a floor comprising:

first and second spaced face anchors for engaging said face, each of said anchors having distal and proximal ends and the distal end of each extending into the geological structure;

first and second truss transition brackets positioned adjacent the face;

means for connecting the proximal end of said anchors to the respective truss brackets to provide support of the face of said geological structure;

at least one elongated truss member attached to and spanning between said brackets for assisting in supporting said face;

means for tensioning said at least one truss member including a driver mechanism; and lifting means for said driver mechanism supported by said floor, whereby an improved truss system is provided that can be efficiently installed and tension activated.

2. The tensioned truss and installation system of claim 1 wherein said face comprises the roof of the passage.

3. The tensioned truss and installation system of claim 2, wherein said tensioning means includes a rotary fastener adjacent said first truss transition bracket, and said lifting means comprises a bolter machine and said driver mechanism includes a rotary drill head of said bolter machine to drive said fastener.

4. The tensioned truss and installation system of claim 1, wherein said tensioning means comprises a rotary fastener including a threaded nut mating with threads on one end of said at least one truss member, gear teeth on the periphery of said nut and a drive gear directly engaging the gear teeth for driving said nut for tensioning.

5. The tensioned truss and installation system of claim 1, wherein is provided a split wedge retainer in a frusto-conical bore in said second truss transition bracket mating with the unthreaded other end of said at least one truss member.

6. The tensioned truss and installation system of claim 1, wherein said driver mechanism includes a rotary drill head of a roof bolter machine and a drive adapter assembly detachably coupled to said rotary drill head.

7. The tensioned truss and installation system of claim 6, wherein said tensioning means comprises a rotary fastener including a threaded nut mating with threads on one end of said at least one truss member, said drive adapter assembly includes a deep well socket or through socket for engaging said nut, a pinion gear connected to said socket to rotate the same and a worm gear for driving said pinion gear.

8. The tensioned truss and installation system of claim 7, wherein the truss system includes an additional truss member extending substantially parallel with said elongated at least one truss member, a nut mating with threads on said one end of each of said truss members for tensioning; and said drive adapter assembly including a pair of integral deep well or through sockets and pinion gears, one deep well socket and pinion gear engaging said worm gear on each side for driving said pair of sockets.

9. The tensioned truss and installation system of claim 8, wherein at least one of said truss members is color coded to indicate an opposite thread of said one end of the additional truss member with respect to said at least one truss member.

10. The tensioned truss and installation system of claim 7, wherein the truss system includes an additional truss member substantially parallel with said at least one truss member, a nut on said one end of each truss member for tensioning;

said drive adapter assembly including a pair of integral deep well or through sockets and pinion gears, first and second worm gears each engaging one of the pair of pinion gears, one of said worm gear and pinion gears being in opposite thread of the other so that the pair of sockets are both driven in the same direction.

11. The tensioned truss and installation system of claim 6, wherein said tensioning means comprises a rotary fastener including a threaded nut mating with threads on one end of said at least one truss member said drive adapter assembly includes an input shaft for direct detachable engagement with a drive socket of said rotary drill head, and a flexible coupling to permit variation in the angle of engagement with the nut being driven.

12. A tensioned truss system for supporting a face of a passage in a geological structure comprising:

first and second spaced face anchors each having distal and proximal ends and the distal end of each extending into the geological structure;

first and second truss transition brackets positioned adjacent the face;

means for connecting the proximal end of said anchors to the respective truss brackets to provide support of the face of said geological structure;

dual elongated truss members attached to and spanning between said brackets for assisting in supporting said face; and means for substantially simultaneously tensioning said truss members, whereby an improved truss system is provided and can be efficiently installed and tension activated.

13. The tensioned truss system of claim 12, wherein said face comprises the roof of the passage.

14. The tensioned truss system of claim 13, wherein said tensioning means includes a rotary fastener for each truss member, and wherein is further included:

installation means comprising a bolter machine;

a driver mechanism including a rotary drill head of said machine;

a detachable drive adapter assembly for said drill head; and a pair of deep well or through sockets on said drive adapter assembly for engaging rotary fasteners on said truss members for tensioning said members.

15. A method of installing and tension activating a truss system for supporting a face of a passage in a geological structure with a bolter machine having a lifter and a driver mechanism comprising the steps of:

drilling spaced bores in said geological structure for receiving anchors utilizing said driver mechanism;

positioning first and second truss transition brackets in proximity to said bores;

installing first and second spaced face anchors through said transition brackets, each anchor having distal and proximal ends with the distal end of each for extending into the geological structure;

providing at least one elongated truss member so as to span between said brackets for assisting in supporting said face;

connecting the proximal end of each of said anchors to the respective first and second truss transition brackets;

lifting said driver mechanism by said lifter on said bolter machine into position adjacent said first and second truss transition brackets; and tensioning said at least one truss member by operative engagement of said driver mechanism with said brackets, whereby an improved truss system is provided that can be efficiently installed and tension activated.

16. The method of claim 15, wherein is further provided the steps of:

providing threads and a mating nut on one end of said at least one truss member and gear teeth on the periphery of said nut; and during tensioning of said at least one truss member driving said nut on said threads by direct engagement with a drive worm gear.

17. The method of claim 15, wherein is further provided the step of:

fixing the other end of said at least one truss member to the second truss transition bracket by a split wedge retainer in a frusto-conical bore in said bracket prior to the tensioning step of said at least one truss member.

18. The method of claim 15, wherein the installing and tension activating is provided with respect to the roof of said passage in the geological structure.

19. A method of activating the tension in a truss system through a driver mechanism including an operative head of a bolter machine, said system including spaced truss transition brackets supported by anchors in a geological structure, and at least one truss member extending between said brackets;

comprising the steps of:

lifting said driver mechanism of said bolter machine into position adjacent at least one of said transition brackets; and tensioning said at least one truss member by operative engagement with said driver mechanism, whereby an improved truss system can be efficiently installed and activated.

20. The method of claim 19, wherein is further provided dual truss members in said system; and comprising the additional steps of:

tensioning said dual truss members substantially simultaneously by operative engagement with said driver mechanism.

* * * * *